US006076479A

United States Patent [19]

Pons Pons

[11] Patent Number: 6,076,479

[45] Date of Patent: Jun. 20, 2000

[54] DEVICE TO OBSERVE THE SEA BED FROM THE DECK OF A VESSEL

[76] Inventor: Dario Pons Pons, Urbanización Santa Ana, C/Tramontana, 17, 07720 Villacanlos-Menorca Baleares, Spain

[21] Appl. No.: 09/315,408

[22] Filed: May 20, 1999

[30] Foreign Application Priority Data

Dec. 1, 1998 [ES] Spain ..... 9803036

[51] Int. Cl.[7] ..... B63B 35/00

[52] U.S. Cl. ..... 114/66; 441/135

[58] Field of Search ..... 114/66; 441/135; 359/402

[56] References Cited

U.S. PATENT DOCUMENTS

| | | | |
|---|---|---|---|
| 756,244 | 4/1904 | Larson | 114/66 |
| 885,087 | 4/1908 | Samaha | 114/66 |
| 4,228,751 | 10/1980 | Robertson et al. | 114/66 |
| 4,895,539 | 1/1990 | Bender | 114/66 |
| 5,526,177 | 6/1996 | Fantone | 359/402 |

*Primary Examiner*—S. Joseph Morano
*Assistant Examiner*—Andrew D. Wright
*Attorney, Agent, or Firm*—Evenson, McKeown, Edwards & Lenahan, P.L.L.C.

[57] ABSTRACT

A device to observe the sea bed from the deck of a vessel is formed by a cubicle that has attachment points to attach it to the structure of the stern of the vessel. This cubicle has a vertical wall that forms a sealed block on the bottom wall of which are the lighting points to illuminate the sea bed. The base of the rest of the cubicle has a resistant transparent glass in contact with the water, since the lights and this glass are on the same plane and below the water line of the vessel. The device has an inclined mirror in the upper part and forms a prolongation of the inclined surface of the block, in which mirror is reflected the sea bed which is seen through the glass and at the same time may be observed from any part of the deck of the vessel.

6 Claims, 1 Drawing Sheet

DEVICE TO OBSERVE THE SEA BED FROM THE DECK OF A VESSEL

BACKGROUND OF THE INVENTION

On many occasions when on a vessel, for interest or professional reasons it is necessary to clearly observe the sea bed, which is impossible using simple methods and means, and to obtain such visualization without the use of apparatus that are sophisticated costly and often difficult to use.

SUMMARY OF THE INVENTION

An object of the present invention is to provide and easy and simple manner of observing the sea bed from the deck of a vessel.

According to the invention, this object has been achieved by providing that the device has a cubicle on the stern of the vessel, attached by metal or fiber attachment points. The device can also be built into the vessel already built by the shipbuilder as original equipment rather than by retrofit.

Therefore the device according to the present invention can advantageously be used in vessels either already built or new.

The cubicle has one end in the form of a sealed block in which are placed some lights and the vessel steering gear, for example the rudder.

The inclined face of the block is prolonged by a mirror, also inclined, on which the sea bed is reflected by a transparent glass forming the bottom of the cubicle.

Optimum visibility is advantageously aided by the intensity of the luminosity of the lights placed in the block area of the cubicle.

A person on the deck can look into the mirror and see the sea bed without the need to be near the device.

BRIEF DESCRIPTION OF THE DRAWINGS

In order to more easily understand not only the formation but also the use of the device of the invention, reference is made below to a practical example, this execution being merely enunciative and in no case limiting the same, all as shown in the attached drawings, where.

DETAILED DESCRIPTION OF THE DRAWINGS

Figure 1:
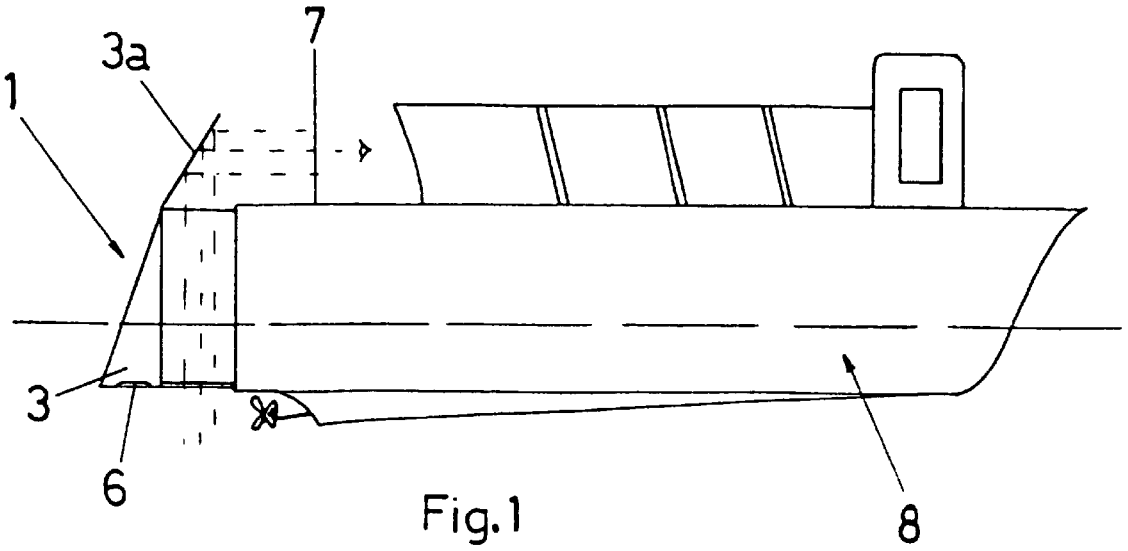
FIG. 1 is a elevational side view of the device of the invention fitted on a vessel shown schematically.
Figure 2:
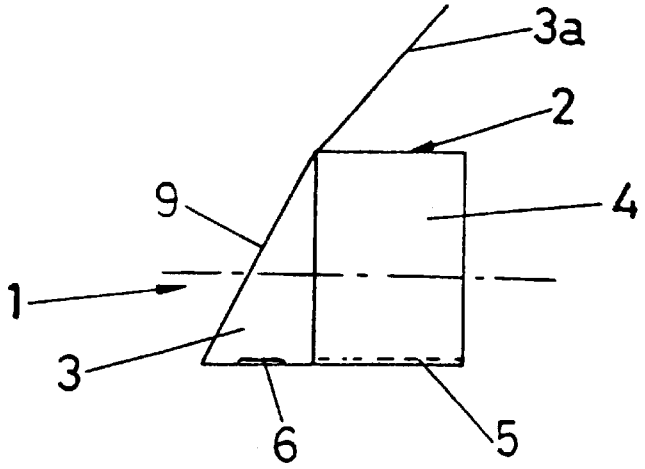
FIG. 2 is a side view of the device schematically shown in FIG. 1.
Figure 3:
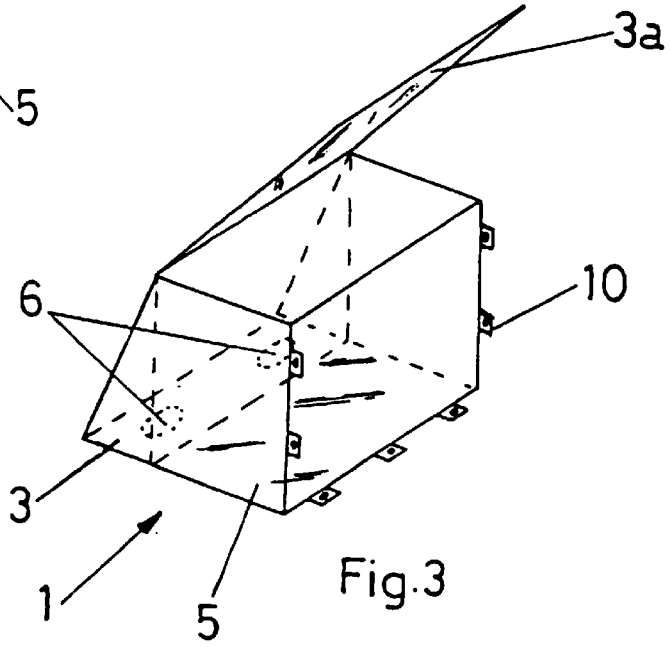
FIG. 3 is a perspective view of the device shown in FIGS. 1 and 2.

The device of the present invention designated generally by numeral 1 is formed by a cubicle 2 formed in part by the block 3 that is extended above by a mirror 3*a* of limited length that is above a cubicle 4 in which there is a transparent glass 5 which forms the bottom of the cubicle itself. This glass 5 is in contact with the water because it is installed to be positioned below the water line of the vessel.

The block 3 has lights 6 in the lower part thereof that light up the water. Both the glass 5 and the lights 6 are below the water line of the vessel.

The sea bed seen through the transparent glass 5 is reflected onto the surface of the mirror 3*a*, and through this mirror 3*a* the sea bed can be seen clearly and in detail, from any part of the deck 7 of the vessel 8. The mirror 3*a* has an inclination angle equal or similar to that of the inclined surface 9 of the block 3. Lastly, the device 1 has lateral attachment points 10 which are used to attach the device 1 to the vessel in a secure manner.

Having sufficiently described the nature of the invention, and the manner of putting into practice, it should be noted that the above layouts indicated and represented in the attached drawings may be modified in detail provided the basic principle is not altered.

What is claimed is:

1. A device to make underwater observation from a deck of a vessel, comprising a cubicle having apparatus for attachment thereof at a stern portion of the vessel, the cubicle having a vertical wall portion and a bottom wall portion forming a sealed block; at least one illumination device operatively arranged in proximity to the bottom wall portion; a transparent glass arranged at the bottom wall portion to allow the underwater observation; and a mirror arranged at an upper portion of the sealed block to permit the underwater observation from a plurality of locations on a deck of the vessel.

2. The device according to claim 1, wherein the at least one illuminating device and the transparent glass are located in approximately the same plane so as to be situated at the same time below a water line of the vessel.

3. The device according to claim 1, wherein the mirror is arranged to be inclinable.

4. The device according to claim 3, wherein a rear surface of the sealed block is inclined relative to the vertical, and the mirror is inclinable to an angle approximately the same as that of the rear surface.

5. The device according to claim 4, wherein the at least one illuminating device and the transparent glass are located in approximately the same plane so as to be situated at the same time below a water line of the vessel.

6. The device according to claim 5, wherein the attachment apparatus comprise lateral attachment points.

* * * * *